US011213737B2

(12) United States Patent
Van Horne et al.

(10) Patent No.: US 11,213,737 B2
(45) Date of Patent: Jan. 4, 2022

(54) FIGURE SKATING BOOT WITH MONOCOQUE STRUCTURE

(71) Applicant: VH Footwear Inc., Winnipeg (CA)

(72) Inventors: Scott Van Horne, Winnipeg (CA); Tyler Anthony Williamson Derraugh, Winnipeg (CA)

(73) Assignee: VH FOOTWEAR INC., Manitoba (CA)

( * ) Notice: Subject to any disclaimer, the term of this patent is extended or adjusted under 35 U.S.C. 154(b) by 94 days.

(21) Appl. No.: 16/552,463

(22) Filed: Aug. 27, 2019

(65) Prior Publication Data

US 2020/0316451 A1 Oct. 8, 2020

Related U.S. Application Data

(60) Provisional application No. 62/829,121, filed on Apr. 4, 2019.

(51) Int. Cl.

| | |
|---|---|
| ***A63C 1/22*** | (2006.01) |
| ***A63C 1/42*** | (2006.01) |
| ***A63C 1/02*** | (2006.01) |
| ***A43B 5/16*** | (2006.01) |

(52) U.S. Cl.

CPC ..... *A63C 1/22* (2013.01); *A43B 5/1641* (2013.01); *A63C 1/02* (2013.01); *A63C 1/42* (2013.01)

(58) Field of Classification Search

CPC ..... A43B 5/1641; A63C 1/02; A63C 1/22

See application file for complete search history.

(56) References Cited

U.S. PATENT DOCUMENTS

| | | | | | |
|---|---|---|---|---|---|
| 4,125,918 | A * | 11/1978 | Baumann | A43C 1/00 | 24/713.3 |
| 4,826,183 | A * | 5/1989 | Bratland | A63C 17/18 | 280/7.13 |
| 5,380,020 | A * | 1/1995 | Arney | A43B 5/1625 | 280/11.231 |
| 5,501,659 | A * | 3/1996 | Morris | A61F 5/0111 | 128/882 |
| 5,738,360 | A * | 4/1998 | Retell | A63C 17/006 | 280/11.222 |
| 5,799,955 | A * | 9/1998 | Iverson | A63C 17/068 | 280/11.19 |

(Continued)

*Primary Examiner* — James A Shriver, II
*Assistant Examiner* — Michael T. Walsh
(74) *Attorney, Agent, or Firm* — Ryan W. Dupuis; Kyle R. Satterthwaite; Ade & Company Inc.

(57) ABSTRACT

A figure skating boot has a monocoque structure formed of monocoque material including a sole portion to receive the foot thereon, inner and outer side wall portions, a heel cup portion about the heel, two ankle portions extending over the ankles, and front and rear mounting surfaces below the sole portion for connection to front and rear ends of a mounting frame, for example the mounting frame of a skate blade. A heel member is formed separately from the boot and is supported by the monocoque material to extend downwardly from the heel end of the sole portion so that the rear mounting surface is at the bottom of the heel member. Each ankle portion is joined to the respective side wall portion by a relief junction enabling the ankle portions of the monocoque structure to be flexed relative to the side wall portions of the monocoque structure.

23 Claims, 4 Drawing Sheets

(56) References Cited

U.S. PATENT DOCUMENTS

| | | | | |
|---|---|---|---|---|
| 6,499,233 | B1 * | 12/2002 | Chenevert | A43B 3/26 36/10 |
| 9,693,600 | B1 * | 7/2017 | Van Horne | A43B 23/0235 |
| 2005/0166426 | A1 * | 8/2005 | Donnadieu | A43B 23/06 36/50.5 |
| 2007/0204482 | A1 * | 9/2007 | Gibson-Collinson | A43D 25/07 36/10 |
| 2012/0011742 | A1 * | 1/2012 | Yang | A43B 23/081 36/45 |
| 2014/0259792 | A1 * | 9/2014 | Van Horne | A43B 5/16 36/115 |
| 2016/0332063 | A1 * | 11/2016 | Van Horne | A43B 5/1691 |
| 2019/0037963 | A1 * | 2/2019 | Huneau | A43B 5/1666 |

* cited by examiner

FIGURE SKATING BOOT WITH MONOCOQUE STRUCTURE

This application claims the benefit under 35 U.S.C. 119(e) of U.S. provisional application Ser. No. 62/829,121, filed Apr. 4, 2019.

FIELD OF THE INVENTION

The present invention relates to a figure skating boot for supporting the foot of a user relative to a lower mounting frame, for example an ice blade holding frame or a wheel holding frame, having a monocoque structure, and more particularly the present invention relates to a skating boot having a monocoque structure having a separately formed heel member incorporated into the monocoque structure below the heel end of the sole portion of the skating boot.

BACKGROUND

Conventional construction of a figure skating boot comprises a wooden or leather sole member incorporating a heel structure therein with a leather upper connected above the wooden sole member to receive the foot of the user therein. A lower mounting frame incorporating a skate blade therein is then fastened to the sole member at the toe end thereof and to the bottom of the heel structure. When the figure skater performs jumps during a figure skating routine, the impact forces when landing jumps are typically localized at the mounting location of the lower mounting frame to the toe end of the sole member and the mounting location of the heel structure at the heel end of the sole member. The localized impact forces can cause undesirable stress and strain to be imposed upon the foot of the figure skater. Furthermore, the upper of the figure skate that receives the foot of the user therein is typically formed of a uniform material having a substantially constant stiffness throughout. The upper is initially quite stiff to provide sufficient supporting structure to support the foot relative to the sole member, however, any flexing of the upper is only achieved by extended use of the figure skate to gradually introduce flexibility into the upper by "breaking in" the upper in a manner which causes considerable discomfort to the figure skater.

SUMMARY OF THE INVENTION

According to one aspect of the invention there is provided a skating boot for receiving a foot of a user therein and for use with a lower mounting frame, the figure skating boot comprising:

a sole portion extending longitudinally between a toe end arranged to receive toes of the foot thereon and a heel end arranged to receive a heel of the foot thereon;

a first mounting surface at a bottom of the sole portion adjacent to the toe end thereof, the first mounting surface being arranged to mount a first portion of the lower mounting frame thereon;

an inner side wall portion and an outer side wall portion oriented generally longitudinally and extending upwardly from laterally opposing sides of the sole portion between the toe end and the heel end towards respective upper free edges which are laterally spaced apart so as to define a lower portion of a tongue opening of the boot therebetween;

a heel cup portion extending upwardly from the heel end of the sole portion in connection between the inner and outer side wall portions;

two ankle portions extending upwardly from laterally opposing sides of the heel cup and extending forwardly to respective forward free edges which are laterally spaced apart and continuous with respective ones of the upper free edges of the side wall portions so as to define an upper portion of the tongue opening of the boot therebetween and for spanning over respective ankles of the foot of the user;

a heel member extending downwardly from the heel end of the sole portion; and a second mounting surface at a bottom of the heel member at a location spaced below the heel end of the sole portion by a height of the heel member, the second mounting surface being arranged to mount a second portion of the lower mounting frame thereon;

the sole portion, the inner and outer side wall portions, the heel cup portion, the ankle portions, and the first and second mounting surfaces comprising a unitary, monocoque structure integrally formed of a structural monocoque material.

The use of a monocoque structure of structural monocoque material which surrounds the heel member and forms a boot body that surrounds the foot of the figure skater provides for more even distribution of impact forces across the foot of the figure skater when landing jumps as compared to connection of the lower mounting frame to the sole member of a convention figure skate construction.

Each ankle portion is preferably joined to a respective one of the side wall portions by a relief junction enabling the ankle portions of the monocoque structure to be flexed relative to the side wall portions of the monocoque structure. In this instance, each relief junction is preferably connected between the forward free edge of the respective ankle portion and the upper free edge of the respective side wall portion of the skating boot. Each relief junction may comprise a protruding channel formed of the structural monocoque material and connected between the respective ankle portion and the respective side wall portion of the skating boot. The protruding channel may forms a pleat in the monocoque structure.

The addition of a relief junction into the monocoque structure maintains adequate support of the foot of the user while allowing some flexing of the upper portion of the boot body without the same degree of discomfort experienced by the figure skater to "break in" the skate boot as required in conventional figure skates.

The structural monocoque material may comprise a composite material including carbon reinforcing material suspended within a matrix material.

Preferably the heel member is fully encased between layers of the monocoque structure.

In one embodiment, the heel member comprises an outer shell formed of a structural shell material which is identical to the structural monocoque material; however, in further embodiments, the heel member may comprise an outer shell formed of a structural plastic material which is different than the structural monocoque material. The outer shell of the heel member may be formed of a structural shell material having a hollow interior. The hollow interior may be filled with a dissimilar material, for example a foam type material. The foam type material may assist in damping vibrations resulting from landing impacts when a figure skater lands on the ice after performing a jump.

In other embodiments, the heel member may comprise a solid core formed of a foam type material which is different than the structural monocoque material. Again, the foam type material may assist in damping vibrations resulting from landing impacts when a figure skater lands on the ice after performing a jump.

The skating boot may further include a rear backing plate covered at an exterior side by a portion of the monocoque structure defining the second mounting surface at the bottom of the heel member in which the rear backing plate comprises a material which is less brittle than the structural monocoque material. Preferably, the rear backing plate comprises a rigid, plastic material.

The skating boot may further include a front backing plate covered at an exterior side by a portion of the monocoque structure defining the first mounting surface at the bottom of the toe end of the sole portion in which the front backing plate comprises a material which is less brittle than the structural monocoque material. Preferably, the front backing plate comprises a rigid, plastic material.

The skating boot may further include (i) a toe cap supported above the toe end of the sole portion to define a toe box area receiving toes of the foot of the user therein and (ii) a rigid tongue supporting member coupled to the toe cap for pivotal movement relative to the toe cap so as to be arranged to extend into the tongue opening thereabove.

The skating boot may further include a plurality of eyelet openings disposed along the upper free edge of each side wall portion for receiving laces therein, and a plurality of lace hooks disposed along the forward free edges of each ankle portion to receive said laces hooked therein, in which the lace hooks are coupled to the monocoque structure using removable threaded fasteners. In this instance, a mounting bar may be supported along the forward free edge of each ankle portion by said threaded fasteners, in which the plurality of lace hooks of each ankle portion are mounted on the respective mounting bar.

According to a second aspect of the present invention there is provided a method of fabricating a skating boot in which the skating boot comprises (i) a sole portion extending longitudinally between a toe end arranged to receive toes of a foot of a wearer thereon and a heel end arranged to receive a heel of the foot thereon, (ii) a first mounting surface at a bottom of the sole portion adjacent to the toe end thereof which is arranged to mount a first portion of the lower mounting frame thereon, (iii) an inner side wall portion and an outer side wall portion oriented generally longitudinally and extending upwardly from laterally opposing sides of the sole portion between the toe end and the heel end towards respective upper free edges which are laterally spaced apart so as to define a lower portion of a tongue opening of the boot therebetween, (vi) a heel cup portion extending upwardly from the heel end of the sole portion in connection between the inner and outer side wall portions, (v) two ankle portions extending upwardly from laterally opposing sides of the heel cup and extending forwardly to respective forward free edges which are laterally spaced apart so as to define an upper portion of the tongue opening of the boot therebetween and for spanning over respective ankles of the foot, (vi) a heel member extending downwardly from the heel end of the sole portion, (vii) a second mounting surface at a bottom of the heel member at a location spaced below the heel end of the sole portion by a height of the heel member which is arranged to mount a second portion of the lower mounting frame thereon, the sole portion, the inner and outer side wall portions, the heel cup portion, the ankle portions, and the first and second mounting surfaces comprising a unitary, monocoque structure, the method comprising:

(a) providing a foot last;

(b) positioning a liner portion, adapted to cushion the foot of the wearer in the skate boot body, on the foot last;

(c) forming the heel member separate from the monocoque structure;

(d) layering wet composite material over said liner portion;

(e) supporting the heel member below the heel end of the sole portion using the wet composite material; and (f) vacuum bagging and heating the wet composite material until the wet composite material has cured into a rigid composite structure matrix defining the monocoque structure of the skate boot body with said heel member integrated therein.

According to a further aspect of the present invention there is provided a skating boot for receiving a foot of a user therein, the skating boot comprising:

a sole portion extending longitudinally between a toe end arranged to receive toes of the foot thereon and a heel end arranged to receive a heel of the foot thereon;

an inner side wall portion and an outer side wall portion oriented generally longitudinally and extending upwardly from laterally opposing sides of the sole portion between the toe end and the heel end towards respective upper free edges which are laterally spaced apart so as to define a lower portion of a tongue opening of the boot therebetween;

a heel cup portion extending upwardly from the heel end of the sole portion in connection between the inner and outer side wall portions; and two ankle portions extending upwardly from laterally opposing sides of the heel cup and extending forwardly to respective forward free edges which are laterally spaced apart so as to define an upper portion of the tongue opening of the boot therebetween and for spanning over respective ankles of the foot of the user;

the sole portion, the inner and outer side wall portions, the heel cup portion, and the ankle portions comprising a unitary, monocoque structure integrally formed of a structural monocoque material; and each ankle portion being joined to a respective one of the side wall portions by a relief junction enabling the ankle portions of the monocoque structure to be flexed relative to the side wall portions of the monocoque structure.

In this instance, each relief junction is preferably connected between the forward free edge of the respective ankle portion and the upper free edge of the respective side wall portion of the skating boot. Each relief junction may comprise a protruding channel formed of the structural monocoque material and connected between the respective ankle portion and the respective side wall portion of the skating boot. The protruding channel may form a pleat in the monocoque structure.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
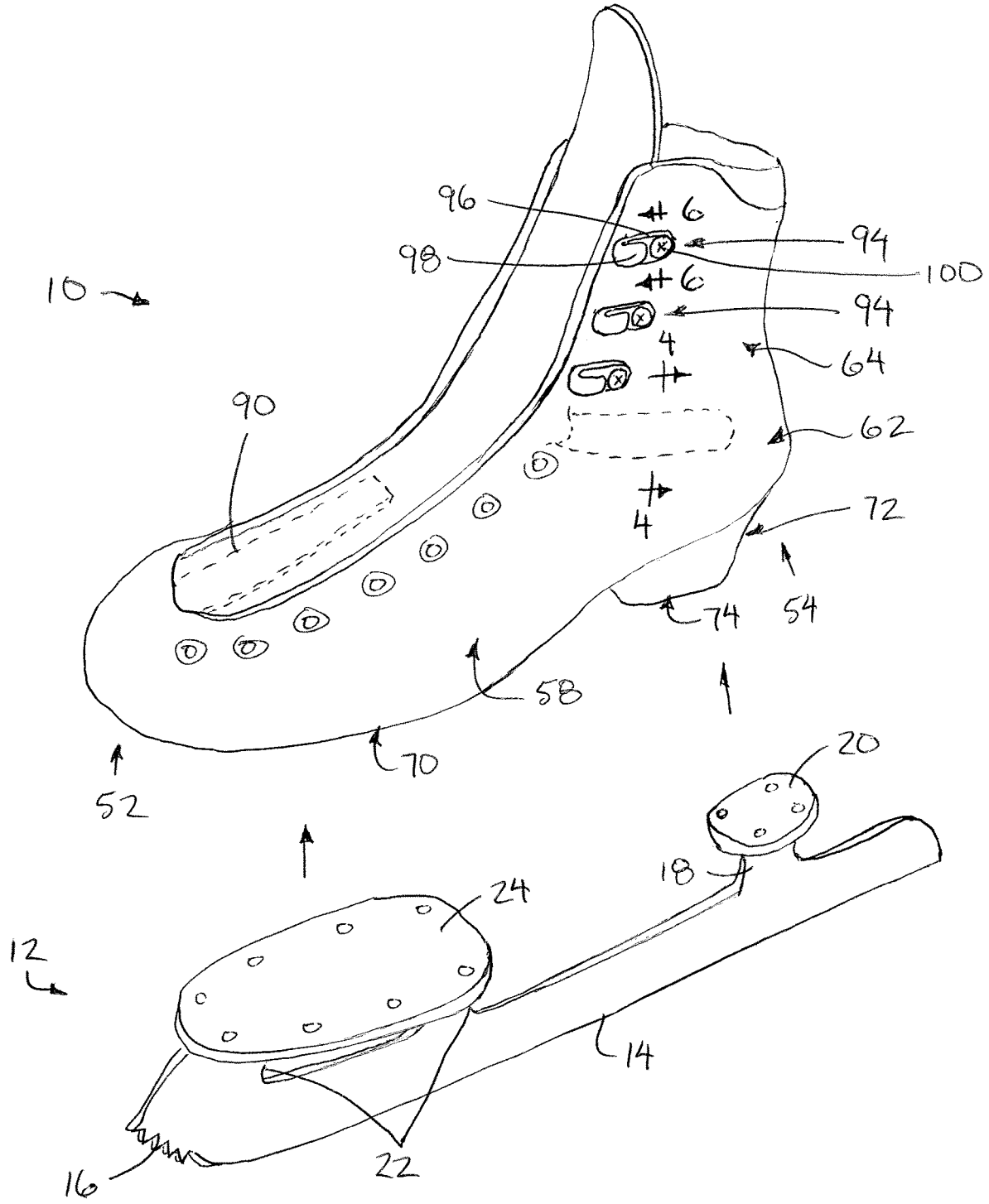
FIG. 1 is a perspective view of the figure skating boot according to the present invention, shown separated from a lower mounting frame incorporating a figure skating blade therein.

Referring to the accompanying figures there is illustrated a figure skating boot generally indicated by reference numeral 10. The skating boot 10 is particularly suited for use with a lower mounting frame 12 of the type including an ice skating blade 14 with a toe pick 16 formed at the front end thereof. The lower mounting frame 12 further includes a rear pedestal 18 extending upwardly from a rear portion of the blade for connection to a rear mounting plate 20 having fastener apertures therein to receive conventional screws for fastening to a bottom side of the skating boot 10. The lower mounting frame 12 also includes front pedestals 22 extending upwardly from longitudinally spaced positions at the front end of the blade for connection to a front mounting plate 24 also having fastener apertures therein to receive conventional screws for fastening to the bottom side of the skating boot 10.

The skating boot generally includes a boot body 30 in the form of a monocoque structure of rigid structural monocoque material, for example reinforcing carbon fibres set in a resin matrix which is cured to form a resulting composite material.

A toe cap 32 is formed separately from the boot body and is subsequently mounted over the toe end of the boot body to overlap a portion of the boot body at the junction between the toe cap and the boot body. The toe cap generally comprises a rigid outer shell 34, for example formed of the composite material noted above or a rigid plastic material, together with a liner layer 36 spanning an inner side of the outer shell in which the liner portion is formed of a low-density, resilient material.

The boot body 30 similarly incorporates a resilient liner integrally therein as described in further detail below.

Subsequent to the formation of the boot body 30, a foot bed layer 40 comprise of a high-density EVA blend foam lines the bottom interior surface of the boot body. An insole layer 42 formed of low-density EVA foam is provided over top of the foot bed layer 40, also within the interior of the boot body at the bottom thereof.

An outer cover 44 formed of a flexible covering material, for example leather or a synthetic material providing an aesthetic exterior covering layer over the boot body fully spans the exterior surfaces of the boot body with the exception of the bottom side of the boot body. The outer cover 44 spans continuously across the toe cap and the remainder of the boot body 32 upon which the toe cap is mounted for covering the seam between the toe cap and the boot body.

A tongue 46 formed of flexible material is connected at a forward end to the toe cap to span rearwardly and upwardly from the toe cap across a tongue opening formed between laterally opposing sides of the boot body.

The boot body 30 is a unitary, seamless, one-piece, integral body. The body includes a sole portion 50 in the form of a base plate spanning from the toe end 52 to the heel end 54 of the boot body for receiving the foot bed layer and the insole layer on the top side thereof which in turn supports the foot of the user thereon.

The boot body further includes an inner side wall portion 56 and an outer side wall portion 58 which extends longitudinally along laterally opposing inner and outer sides of the boot body from the toe end 52 to the heel end 54 thereof. The side wall portions extend upwardly from the opposing sides of the sole portion to respective upper free edges 60 which define a lower portion of the tongue opening of the boot body therebetween.

A heel cup portion 62 of the boot body extends upwardly from the heel end of the sole portion 50 in a curved shape about the rear end of the boot body so as to be joined between the inner and outer side wall portions at the rear of the boot body.

A pair of ankle portions 64 of the boot body extend upwardly from laterally opposing sides of the heel cup in connection with the inner and outer side wall portions respectively. The ankle portions 64 are joined with one another at the rear of the boot body above the heel cup such that the ankle portions collectively form a cuff extending about a majority of the circumference of the lower leg of the user between opposing front free edges 66 of the ankle portions. More particularly each ankle portions extend forwardly from the rear of the boot body to the front free edge 66 thereof to define an upper portion of the tongue opening in the boot body spanning laterally between the two ankle portions. The upper portion of the tongue opening between the front free edges 66 is continuous with the lower portion of the tongue opening between the upper free edges of the inner and outer side wall portions of the boot body. More particularly the front free edges 66 of the ankle portions are continuous with the upper free edges of the side wall portions respectively.

Each ankle portion is joined to the respective side wall portion of the boot body by a relief junction 68 in which the structural material forming the boot body is continuous at the free edges from the side wall portions to the ankle portions respectively but with the material at each relief junction protruding outwardly relative to a remainder of the boot body surrounding the relief junction. The outwardly protruding material at the relief junction 68 forms a channel extending longitudinally from a forward end of the channel open to the tongue opening of the boot body to a rear end of the channel which is positioned rearwardly and downwardly in relation to the forward end. The channel of each relief junction 68 is generally constant in profile so as to be generally U-shaped in an outward protrusion from a plane of the remainder of the side wall and ankle portions of the boot body. Due to the inner ends of the channels extending forwardly up to the tongue opening, the free edges of the boot body at laterally opposing sides of the tongue opening similarly form an outward protrusion at the junction between the upper free edges of the side wall portions in the forward free edges of the ankle portions.

The outward protruding structural material of the boot body at each relief junction functionally forms a pleat in which the material can be flexed outwardly as the material at the channel is hinged or flexed relative to the ankle portions thereabove or the side wall portions therebelow. More particularly, the shape of the boot body forming the integral channels at each relief junction 68 of the boot body causes the boot body to be more resilient at the relief junctions than throughout the remainder of the boot body despite the structural material of the boot body being substantially continuous across the boot body. The ankle portions of the boot body can thus be flexed forwardly towards the toe end of the boot body together with flexing of the ankle of the user while maintaining a rigid structural support of the boot body about the foot and lower leg of the user.

The bottom side of the sole portion of the boot body defines a first mounting surface 70 which is generally flat and suitable for receiving the front mounting plate 24 of the lower mounting frame supported externally thereon when fastening the lower mounting frame to the boot body. The first mounting surface 70 provides structural support to the front mounting plate either by direct abutment of the front mounting plate to the first mounting surface, or by mounting of the front mounting plate parallel to the first mounting surface with one or more additional structural layers of material therebetween as described in further detail below.

The boot body integrally receives a heel member 72 therein between layers of the structural material forming the boot body. The heel member is supported at the bottom of the heel end of the sole portion of the boot body.

Figure 2:
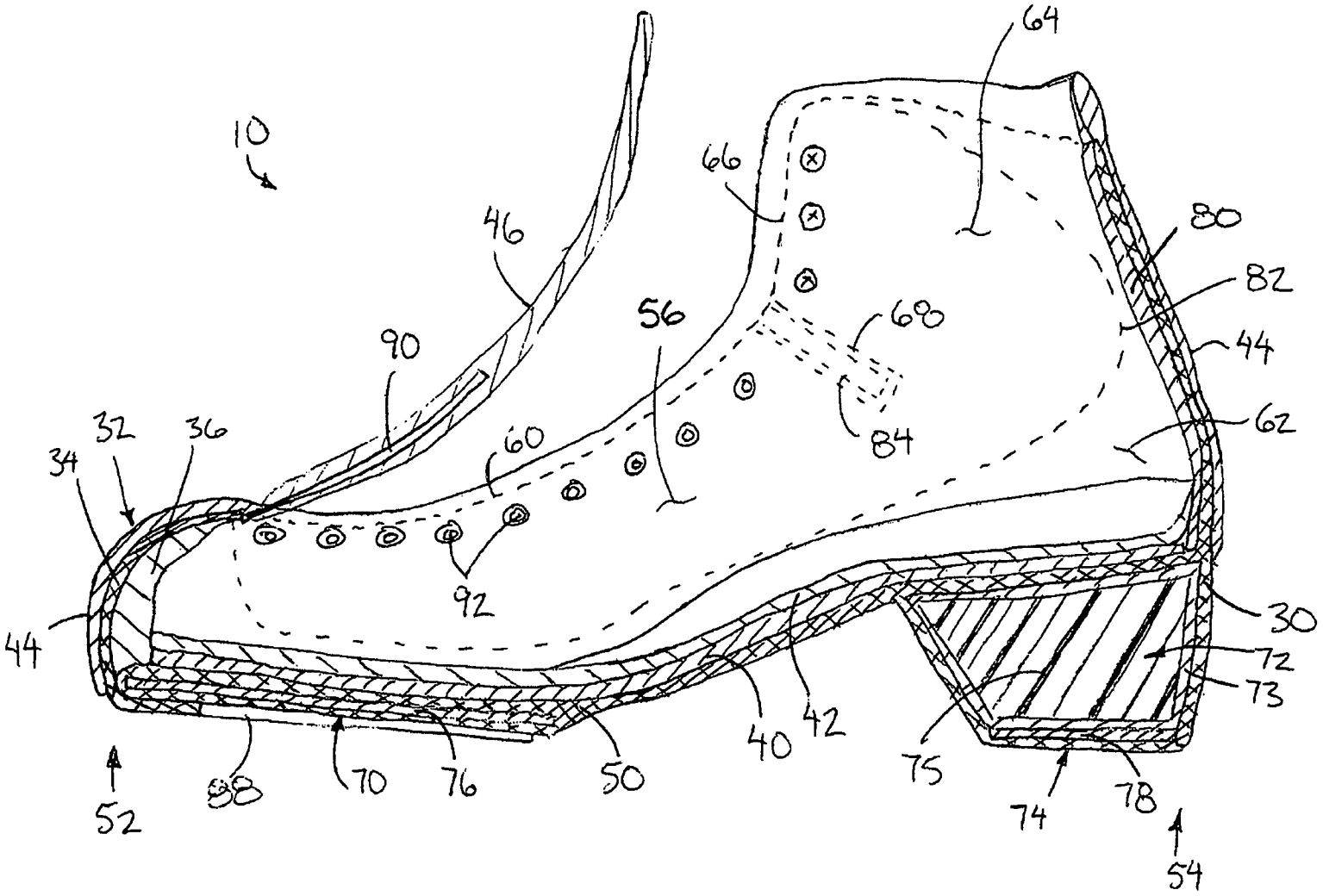
FIG. 2 is a sectional view along an upright longitudinal plane of the figure skating boot according to FIG. 1.
Figure 3:
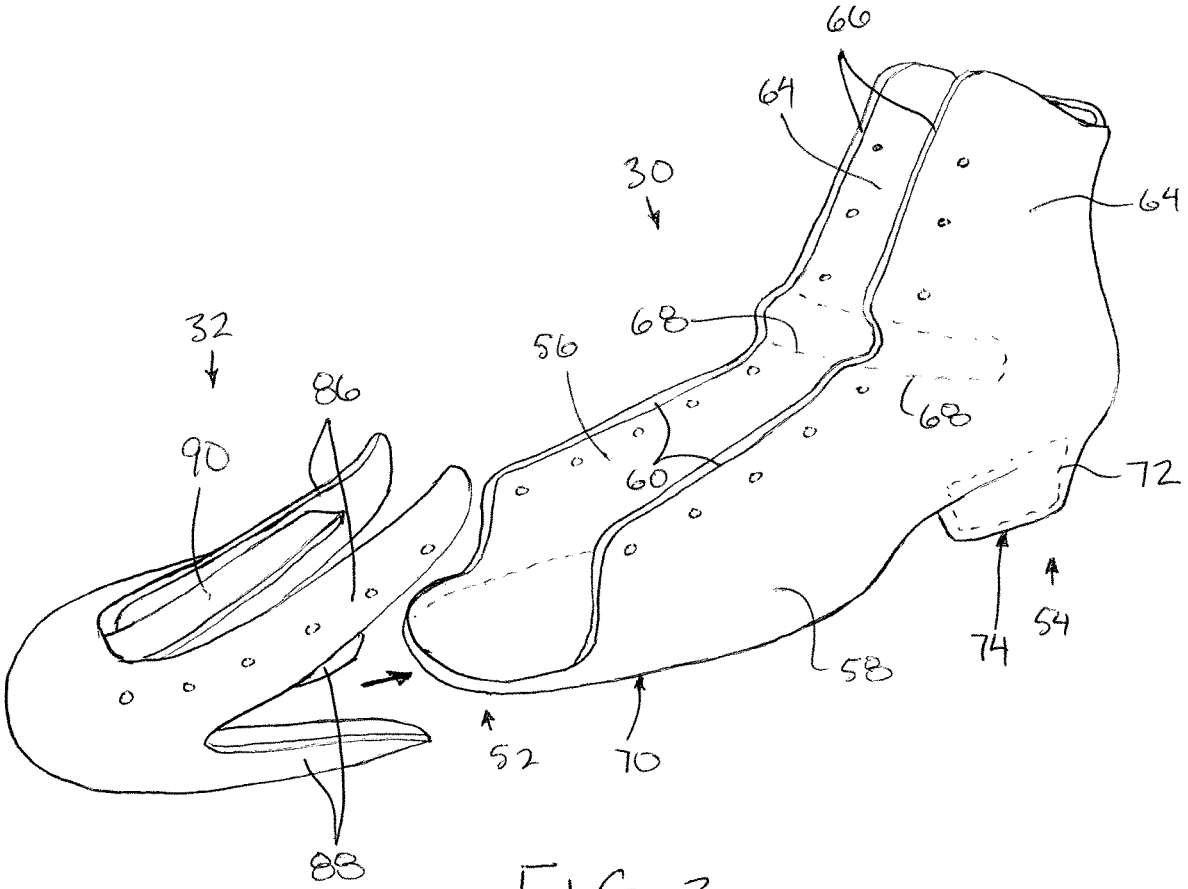
FIG. 3 is a perspective view of the monocoque structure of the skating boot according to FIG. 1 prior to attachment of the toe cap of the skating boot, and in which the outer cover of the skating boot has been removed for illustrative purposes.
Figure 4:
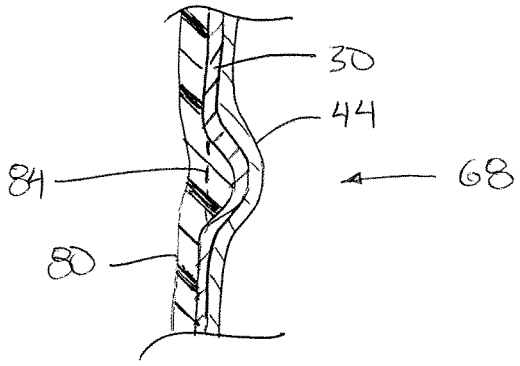
FIG. 4 is a sectional view along the line 4-4 in FIG. 1 which illustrates a shape of the relief junction in the monocoque structure, with the monocoque structure shown received between an inner liner layer and an outer cover layer.

In the illustrated embodiment of FIG. 2, the heel member comprises a pre-formed or separately formed outer shell 73 of plastic material or carbon fiber and the like having a hollow interior which is optionally filled with a solid core of vibration damping foam 75. The outer shell is cured into a rigid form prior to placement between layers of wet structural material used to form the boot body.

In another embodiment, the heel member 72 consists only of a milled piece of high density foam type material which forms a unitary solid core within the heel region of the skate boot. The foam type material is milled into the correct shape prior to placement between layers of wet structural material forming the skate boot.

In either embodiment of the heel member 72, the heel member is mounted in place by providing a first layer of wet structural material over the bottom of the sole portion, followed by placement of the heel member below the bottom of the heel end of the sole portion of the boot body as the layers of structural material forming the boot body are assembled during manufacturing. Additional layers of the structural material extend over the exterior of the heel member to both support the heel member relative to the boot body and to define a second mounting surface 74 of the structural material spanning the bottom side of the heel member 72. The second mounting surface is suitable for receiving the rear mounting plate 20 of the lower mounting frame abutted against it when fastening the lower mounting frame to the boot body.

In some embodiments rubber and materials of the like could be affixed to the surface 74 to function like a gasket to improve the fit and marriage of surface 20.

The boot body 30 also incorporates a front backing plate 76 and a rear backing plate 78 therein in which both of the backing plates comprise a rigid plastic material which is more resilient and less brittle than the structural material of the remainder of the boot body so as to be suitable for accepting conventional mounting screws used for mounting the lower mounting frame against the bottom of the boot body. The backing plates 76 and 78 are mounted between layers of the structural material of the boot body during manufacturing thereof such that both backing plates are covered at the bottom or exterior side thereof by some of the structural material of the monocoque boot body which defines the first and second mounting surfaces 70 and 74 respectively. More particularly, an initial layer of the structural material is first placed over the bottom of the heel member in position below the sole portion before placement of the rear backing plate 78, followed by additional layers of the structural material about the exterior and bottom of the rear backing plate after the backing plate has been properly positioned.

The front backing plate 76 is generally U-shaped in plan view, while being generally flat for incorporation between layers of structural material forming the sole portion of the boot body. The front backing plate locates material at laterally opposing sides and across the front end of the toe portion of the sole portion of the boot body for alignment with the fastener apertures in the front mounting plate of the lower mounting frame. In the illustrated embodiment, the rear backing plate 78 is a separate member from the outer shell of the heel member and is shaped to fully span the bottom side of the heel member so as to be well suited for alignment with the fastener apertures in the rear mounting plate of the lower mounting frame.

In further embodiments however, the rear backing plate 78 may be formed by the bottom panel of the outer shell of the heel member itself, or the rear backing plate may be a separate plate which is incorporated into layers of the material forming the outer shell of the heel member. In all embodiments however, the backing plate comprises a panel of material which is less brittle than the composite structural material forming the monocoque boot body and which is located at the bottom of the heel member and which is covered at the exterior side by the monocoque material.

In order to manufacture the skating boot, a foot last is initially formed, which may be a generic shape and size, or which may be custom manufactured according to the foot of a designated user. Once the foot last has been formed, a layer of liner material 80 is provided about the foot last at the location of the side walls, the heel cup, and the ankle portions. The liner material 80 includes an inner liner, for example a Clarino fabric layer, together with a low-density foam backing layer.

A pair of thermoplastic panels 82 are provided at laterally opposing sides of the boot body such that each panel spans a majority of each ankle portion and each side wall portion at the respective side of the boot body. The thermoplastic panel can be shaped to closely conform to the shape of the foot of the user when heated to further customize the shape of the skate boot to the user.

To form the shape of the relief junctions, an insert 84 of a soft resilient material may be added to the liner or to the foot last at each side of the assembly in alignment with the location of the relief junctions. The insert may comprise a soft resilient material strip which defines the protruding shape of the channel of each relief junction, and can be removed after fabrication to leave a hollow consistently shaped protruding channel.

Wet composite material is then layered over top of the liner material 80, the thermoplastic panels 82 and the inserts 84 to fully span the sole portion, the ankle portions, the side wall portions, and the heel cup portion of the resulting boot body. While layering wet composite material about the foot last, the operator places the heel member 82 against the bottom side of the sole portion at the heel end thereof and provides additional layers of wet composite material to fully surround the heel member such that the wet composite material provides structural support to retain the heel member incorporated into the boot body as the heel member becomes encased between layers of the wet composite material which are subsequently cured.

When manufactured according to the illustrated embodiment, the backing plates 76 and 78 are also placed between layers of the wet composite material being applied such that the rear backing plate is located at the bottom of the heel member and the front backing plate is located at the bottom of the sole portion of the boot body. However, in further embodiments, the rear backing plate may be part of the heel member such that the rear backing plate is in proper position simply by placement of the heel member relative to the boot body.

Once the backing plates have also been covered at the bottom or exterior side thereof by wet composite material, the assembly is surrounded by a bag having a vacuum applied thereto such that the vacuumed envelope applies uniform pressure about the exterior of the boot body while heat is applied until the wet composite material cures into a rigid structural material of the monocoque structure. The cured structural material of the boot body thus encapsulates the heel member 72 and the backing plates 76 and 78 so that they are fully surrounded by the cured structural material of the boot body. Upon removal from the vacuum envelope, the free edges of the boot body are smoothed along the upper edges of the cuff at the top of the boot body, along the opposing sides of the tongue opening, and at the forward edges of the side wall portions which terminate rearwardly of the toe end of the sole portion.

The toe cap is separately formed using a plastic material or a similar structural composite material as the boot body to form an outer shell 34 of the toe cap with the liner portion 36 integrally attached at the inner surface of the toe cap. The toe cap includes a generally spherical forward portion of the toe cap which encloses the toe end of the skate boot body by being suspended above the toe end of the sole portion to define a toe box for receiving toes of the user therebetween. The toe cap assembly also includes (i) two upper flanges 86 extending upwardly and rearwardly from the forward portion of the toe cap along the upper free edges of the side wall portions for overlapping the side wall portions along the upper free edges thereof, and (ii) two lower flanges 88 protruding rearwardly from laterally opposing sides of the forward portion of the toe cap to overlap laterally opposing side edges of the sole portion to assist in adequately securing the toe cap relative to the remainder of the boot body. The bottom end of the spherical front portion of the toe cap meets the front edge of the sole portion of the boot body to fully enclose the toe box area of the boot body.

Figure 5:
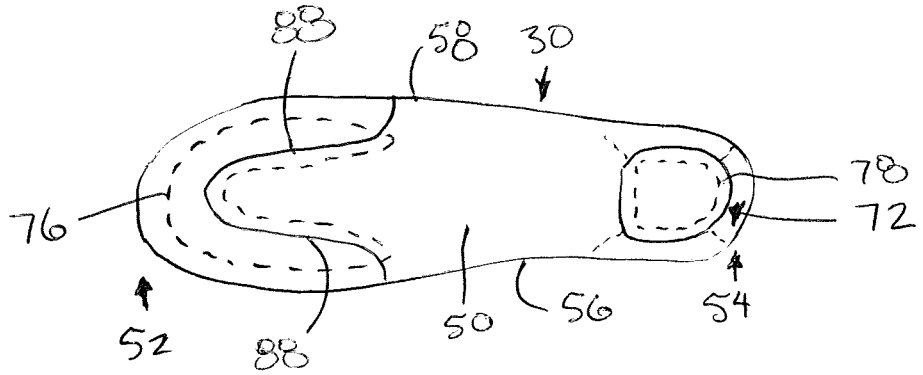
FIG. 5 is a bottom plan view of the skating boot according to FIG. 1, illustrating an outline of the forward and rear backing plates incorporated into the sole portion of the monocoque structure.
Figure 6:
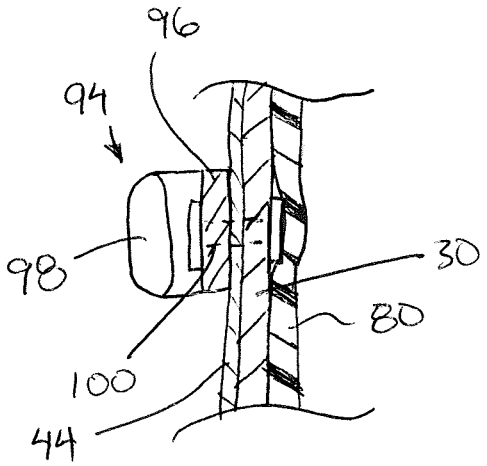
FIG. 6 is a sectional view along the line 6-6 in FIG. 1 which illustrates a connection of one of the lace hooks to the monocoque structure using threaded fasteners.

The two lower flanges 88 overlap the bottom side of the monocoque boot body at the toe end thereof as shown in FIG. 5 such that the lower flanges 88 are received between the first mounting surface 70 of the boot body and the front mounting plate 24 of the lower mounting frame in the assembled configuration of the skate boot.

The toe cap further includes a tongue support member 90 in the form of a rigid plate which is pivotally coupled to the trailing edge of the spherical forward portion of the toe cap to extend upwardly and rearwardly therefrom within the lower portion of the tongue opening. The tongue 46 is subsequently mounted about the tongue support member 90. The rigid tongue supporting member extends into the tongue opening and spans along a majority of a length of said lower portion of the tongue opening that is defined between the upper free edges of the inner side wall portion and the outer side wall portion. The majority of the tongue 46 is formed of flexible materials conforming to the shape of the foot of the user, however the lower or forward portion of the tongue is secured about the tongue supporting member 90 to prevent kinking or bunching of the lower portion of the tongue in use.

Once the boot body has been manufactured and the toe cap is attached, the foot bed liner 40 and the insole layer 42 can then be placed within the interior of the boot body. The tongue 46 is attached to the tongue support member 90 such that the tongue fully spans the width of the tongue opening in overlapping arrangement with a portion of each side wall portion at laterally opposing sides of the tongue opening while also spanning the full length and height of the tongue opening to an upper end of the tongue which terminates above the upper end of the boot body in a mounted position.

The cover layer 44 is mounted to fully span the exterior of the boot body with the exception of the bottom side thereof to span across and conceal the junction of the toe cap to the remainder of the boot body while also spanning the side wall portions, the heel cup portion and the ankle portions of the boot body. At the upper free edges of the side wall portions of the boot body and the forward free edges of the ankle portions of the boot body, the cover layer material 44 extends upwardly and forwardly beyond the free edges of the monocoque boot body similarly to the corresponding edges of the liner material 80 within the interior of the boot body such that the liner material 80 and the cover material 44 can be stitched together along the upper and forward free edges of the boot body.

A plurality of eyelet openings 92 are provided at longitudinally spaced apart from one another within a single row within each side wall portion along the upper free edges thereof in which the eyelet openings are penetrated through the layers of the liner material 80 the monocoque boot body 30 and the exterior cover material 44 to enable an eyelet ring to be mounted within each opening for subsequently receiving laces threaded therethrough.

The skate boot also includes a plurality of lace hooks 94 in which a single row of three longitudinally spaced apart lace hooks are provided on each ankle portion along the forward free edges thereof. Each lace hook comprises a mounting portion 96 which is fastened flat against the exterior of the boot body and a hook portion 98 protruding outward from the mounting portion to define a hook which is adapted for hooking a portion of the laces therein. A fastener aperture is provided within the mounting portion of each lace hook which receives a threaded fastener 100 penetrated therethrough in which the fastener extends through a corresponding fastener aperture in the monocoque boot body and the cover material 44 at the outer side thereof. Although the fastener may also extend through the liner material 80, in the preferred embodiment the fastener only goes through the monocoque boot body and not the liner as liner is separated from the monocoque body to allow insertion of a nut for the fastener between the liner and body to provide a much more aesthetic look. The lace hooks can be readily interchanged with replacement lace hooks by removal and reattachment of the threaded fastener extending through the fastener aperture.

Figure 7:
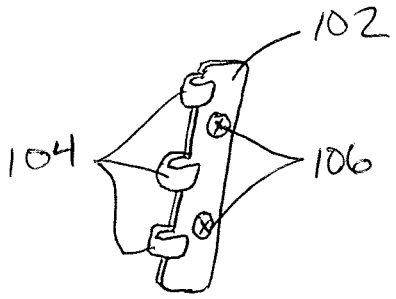
FIG. 7 is a perspective view of an alternative configuration of the lace hooks for use within the figure skating boot according to FIG. 1.

Turning now to FIG. 7, according to an alternative embodiment of the lace hooks, the skate boot 10 as described above may instead be provided with a mounting bar 102 mounted at the exterior side of the skating boot at each ankle portion thereof in which the mounting bar as an elongate rigid member oriented generally parallel to the forward free edge of the corresponding ankle portion of the skate boot. Each mounting bar 102 mounts a plurality of lace hooks 104 integrally thereon such that in the illustrated embodiment all three lace hooks are supported on a common mounting bar. A pair of fastener holes are provided within the mounting bar at spaced positions thereon to receive corresponding threaded fasteners 106 therein which are penetrated through corresponding apertures in the monocoque boot body 30, the liner material 80 at the inner side thereof, and the cover material 44 at the outer side thereof. The number of fasteners required to secure each mounting bar is less than the number of lace hooks in the illustrated embodiment such that all three lace hooks can be readily interchanged by removal of only two threaded fasteners. In the event of one of the lace hooks being broken, the placement of the corresponding mounting bar 102 enables all lace hooks at that side of the boot body to be changed together.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A skating boot for receiving a foot of a user therein and for use with a lower mounting frame, the skating boot comprising:

a sole portion extending longitudinally from a toe end arranged to receive toes of the foot thereabove towards a heel end arranged to receive a heel of the foot thereabove;

a first mounting surface at a bottom of the sole portion adjacent to the toe end thereof, the first mounting surface being arranged to mount a first portion of the lower mounting frame thereon;

an inner side wall portion and an outer side wall portion oriented generally longitudinally and extending upwardly from laterally opposing sides of the sole portion between the toe end and the heel end towards respective upper free edges which are laterally spaced apart so as to define a lower portion of a tongue opening of the boot therebetween;

a heel cup portion extending upwardly from the heel end of the sole portion in connection between the inner and outer side wall portions;

two ankle portions extending upwardly from laterally opposing sides of the heel cup and extending forwardly to respective forward free edges which are laterally spaced apart and continuous with respective ones of the upper free edges of the side wall portions so as to locate an upper portion of the tongue opening of the boot therebetween and for spanning over respective ankles of the foot of the user;

a heel member extending downwardly from the heel end of the sole portion; and a second mounting surface at a bottom of the heel member at a location spaced below the heel end of the sole portion by a height of the heel member, the second mounting surface being arranged to mount a second portion of the lower mounting frame thereon;

the sole portion, the inner and outer side wall portions, the heel cup portion, the ankle portions, the first mounting surface and the second mounting surface collectively defining a unitary, monocoque structure integrally formed of a common structural monocoque material.

2. The skating boot according to claim 1 wherein each ankle portion is joined to a respective one of the side wall portions by a relief junction enabling the ankle portions of the monocoque structure to be flexed relative to the side wall portions of the monocoque structure.

3. The skating boot according to claim 2 wherein each relief junction is connected between the forward free edge of the respective ankle portion and the upper free edge of the respective side wall portion of the skating boot.

4. The skating boot according to claim 2 wherein each relief junction comprises a protruding channel formed of the structural monocoque material and connected between the respective ankle portion and the respective side wall portion of the skating boot.

5. The skating boot according to claim 4 wherein the protruding channel forms a pleat in the monocoque structure.

6. The skating boot according to claim 1 wherein the structural monocoque material comprises a composite material including carbon reinforcing material suspended within a matrix material.

7. The skating boot according to claim 1 wherein the heel member is fully encased between layers of the monocoque structure.

8. The skating boot according to claim 1 wherein the heel member comprises an outer shell formed of a structural shell material which is identical to the structural monocoque material.

9. The skating boot according to claim 1 wherein the heel member comprises an outer shell formed of a structural plastic material which is different than the structural monocoque material.

10. The skating boot according to claim 1 wherein the heel member includes an outer shell formed of a structural shell material having a hollow interior.

11. The skating boot according to claim 10 wherein the hollow interior is filled with a dissimilar material.

12. The skating boot according to claim 1 wherein the heel member comprises a solid core formed of a foam type material which is different than the structural monocoque material.

13. The skating boot according to claim 1 further comprising a rear backing plate covered at an exterior side by a portion of the monocoque structure defining the second mounting surface at the bottom of the heel member in which the rear backing plate comprises a material which is less brittle than the structural monocoque material.

14. The skating boot according to claim 13 wherein the rear backing plate comprises a rigid, plastic material.

15. The skating boot according to claim 1 further comprising a front backing plate covered at an exterior side by a portion of the monocoque structure defining the first mounting surface at the bottom of the toe end of the sole portion in which the front backing plate comprises a material which is less brittle than the structural monocoque material.

16. The skating boot according to claim 15 wherein the front backing plate comprises a rigid, plastic material.

17. The skating boot according to claim 1 further comprising a plurality of eyelet openings disposed along the upper free edge of each side wall portion for receiving laces therein, and a plurality of lace hooks disposed along the forward free edges of each ankle portion to receive said laces hooked therein, the lace hooks being coupled to the monocoque structure using removable threaded fasteners.

18. A skating boot for receiving a foot of a user therein, the skating boot comprising:

a sole portion extending longitudinally from a toe end arranged to receive toes of the foot thereabove towards a heel end arranged to receive a heel of the foot thereabove;

an inner side wall portion and an outer side wall portion oriented generally longitudinally and extending upwardly from laterally opposing sides of the sole portion between the toe end and the heel end towards respective upper free edges which are laterally spaced apart so as to define a lower portion of a tongue opening of the boot therebetween;

a heel cup portion extending upwardly from the heel end of the sole portion in connection between the inner and outer side wall portions;

two ankle portions extending upwardly from laterally opposing sides of the heel cup and extending forwardly to respective forward free edges which are laterally spaced apart so as to define an upper portion of the tongue opening of the boot therebetween and for spanning over respective ankles of the foot of the user;

the sole portion, the inner and outer side wall portions, the heel cup portion, and the ankle portions comprising a unitary, monocoque structure integrally formed of a structural monocoque material;

a toe cap supported above the toe end of the sole portion to define a toe box area receiving toes of the foot of the user therein;

a rigid tongue supporting member coupled to the toe cap for pivotal movement relative to the toe cap, the rigid tongue supporting member extending into the tongue opening and spanning along a majority of a length of said lower portion of the tongue opening that is defined between the upper free edges of the inner side wall portion and the outer side wall portion; and a tongue formed of flexible material and extending across the lower portion and the upper portion of the tongue opening, the flexible tongue being connected to the rigid tongue supporting member so as to prevent bunching of a lower portion of the tongue.

19. A skating boot for receiving a foot of a user therein, the skating boot comprising:

a sole portion extending longitudinally from a toe end arranged to receive toes of the foot thereabove towards a heel end arranged to receive a heel of the foot thereabove;

an inner side wall portion and an outer side wall portion oriented generally longitudinally and extending upwardly from laterally opposing sides of the sole portion between the toe end and the heel end towards respective upper free edges which are laterally spaced apart so as to define a lower portion of a tongue opening of the boot therebetween;

a heel cup portion extending upwardly from the heel end of the sole portion in connection between the inner and outer side wall portions;

two ankle portions extending upwardly from laterally opposing sides of the heel cup and extending forwardly to respective forward free edges which are laterally spaced apart so as to define an upper portion of the tongue opening of the boot therebetween and for spanning over respective ankles of the foot of the user;

the sole portion, the inner and outer side wall portions, the heel cup portion, and the ankle portions comprising a unitary, monocoque structure integrally formed of a structural monocoque material;

a plurality of eyelet openings disposed along the upper free edge of each side wall portion for receiving laces therein, a rigid mounting bar supported along the forward free edge of each ankle portion above the eyelet openings; and a plurality of lace hooks each mounting bar so as to be located along the forward free edges of each ankle portion to receive said laces hooked therein;

each mounting bar being secured to a corresponding one of the ankle portions of the monocoque structure using a plurality of removable threaded fasteners.

20. The skating boot according to claim 19 wherein a number of the threaded fasteners securing each mounting bar to the monocoque structure is less than a number of the lace hooks on that mounting bar.

21. A skating boot for receiving a foot of a user therein, the skating boot comprising:

a sole portion extending longitudinally from a toe end arranged to receive toes of the foot thereabove towards a heel end arranged to receive a heel of the foot thereabove;

an inner side wall portion and an outer side wall portion oriented generally longitudinally and extending upwardly from laterally opposing sides of the sole portion between the toe end and the heel end towards respective upper free edges which are laterally spaced apart so as to define a lower portion of a tongue opening of the boot therebetween;

a heel cup portion extending upwardly from the heel end of the sole portion in connection between the inner and outer side wall portions; and two ankle portions extending upwardly from laterally opposing sides of the heel cup and extending forwardly to respective forward free edges which are laterally spaced apart so as to define an upper portion of the tongue opening of the boot therebetween and for spanning over respective ankles of the foot of the user;

the sole portion, the inner and outer side wall portions, the heel cup portion, and the ankle portions comprising a unitary, monocoque structure integrally formed of a structural monocoque material; and each ankle portion being joined to a respective one of the side wall portions by a relief junction enabling the ankle portions of the monocoque structure to be flexed relative to the side wall portions of the monocoque structure;

wherein each relief junction comprises a protruding channel formed of the structural monocoque material and connected between the respective ankle portion and the respective side wall portion of the skating boot.

22. The skating boot according to claim 21 wherein each relief junction is connected between the forward free edge of the respective ankle portion and the upper free edge of the respective side wall portion of the skating boot.

23. The skating boot according to claim 21 wherein the protruding channel forms a pleat in the monocoque structure.

* * * * *